US006385818B1

(12) United States Patent
Savicki, Sr.

(10) Patent No.: US 6,385,818 B1
(45) Date of Patent: May 14, 2002

(54) END STOP AND SLIDER FOR RECLOSABLE FASTENER

(75) Inventor: Alan F. Savicki, Sr., Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/612,736

(22) Filed: Jul. 10, 2000

(51) Int. Cl.[7] ..... A44B 19/36

(52) U.S. Cl. ..... 24/30.5 R; 24/387; 24/399; 24/435

(58) Field of Search ..... 24/399, 400, 415, 24/387, 389, 390, 435, 436, 30.5 R; 383/64, 69

(56) References Cited

U.S. PATENT DOCUMENTS

| | | | | |
|---|---|---|---|---|
| 2,287,349 | A | | 6/1942 | Hirsch |
| 3,805,339 | A | | 4/1974 | Howell |
| 3,990,130 | A | * | 11/1976 | Hattori |
| 4,602,405 | A | * | 7/1986 | Sturman et al. |
| 4,825,514 | A | | 5/1989 | Akeno |
| 4,890,935 | A | * | 1/1990 | Ausnit et al. |
| 4,995,656 | A | * | 2/1991 | Akashi |
| 5,031,944 | A | * | 7/1991 | Keyaki |
| 5,161,286 | A | | 11/1992 | Herrington et al. |
| 5,189,764 | A | | 3/1993 | Herrington et al. |
| 5,253,395 | A | * | 10/1993 | Yano |
| 5,681,115 | A | | 10/1997 | Diederich et al. |
| 5,950,285 | A | | 9/1999 | Porchia et al. |
| 5,991,980 | A | | 11/1999 | Meager |

FOREIGN PATENT DOCUMENTS

| | | | |
|---|---|---|---|
| CA | 844815 | | 6/1970 |
| FR | 1170370 | * | 1/1959 |
| IT | 558072 | * | 6/1958 |

* cited by examiner

*Primary Examiner*—James R. Brittain
(74) *Attorney, Agent, or Firm*—Thomas C. Feix

(57) ABSTRACT

A closure device for a slider bag with a slider and an end stop operable to releasably latch the slider in the closed position and release the slider with minimal user applied force. The closure device includes first and second interlocking fastening strips arranged to be interlocked over a predetermined length. The slider is slidably disposed on the interlocking fastening strips for facilitating the occlusion and deocclusion of the fastening strips when moved towards first and second ends of the fastening strips. The first and second ends of the fastening strips are secured together and an end stop is provided to the first, closing end of the fastening strips. The end stop is provided with quick release latching structure engagable with cooperating latch-receiving structure provided to the mating or opening end of the slider to secure the slider when it is moved into engagement with the end stop at the closing end of the bag.

40 Claims, 6 Drawing Sheets

END STOP AND SLIDER FOR RECLOSABLE FASTENER

FIELD OF THE INVENTION

The present invention relates to improvements in closure devices for plastic storage bags, and more particularly, to plastic reclosable fasteners with sliders for opening and closing the reclosable fasteners on the bag and end stops with engagement means for releasably latching the sliders at the closing end of the bags.

BACKGROUND OF THE INVENTION

The use of closure devices for fastening storage containers, including plastic bags, is generally known. Furthermore, the manufacture of closure devices made of plastic materials is generally known to those skilled the in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece.

Alternatively, the closure device and sidewall of the container may be formed as separate pieces and then connected by heat sealing or any other suitable connecting process. In either event, such closure devices are particularly useful in providing closure means for retaining matter within the bag.

Conventional closure devices typically utilize mating fastening strips or closure elements, which are used to selectively seal the bag. In addition, sliders may be provided for use in opening and closing the fastening strips. Such reclosable bags equipped with sliders are known in the art as "slider bags." The slider may include a separator which extends at least partially between the fastening strips. When the slider is moved in the opening direction, the separator divides or deoccludes the fastening strips and opens the bag. When the slider is moved in the closing direction, the slider closes or occludes the fastening strips.

It is well known in the art to provide one or both ends of the reclosable fastener of a slider bag with an end stop to prevent movement of the slider past the ends of the bag. The end stop may be formed from the material of the fastening strips as is known from U.S. Pat. No. 5,950,285 to Porchia et al. Alternatively, the end stop may be formed as a separate plastic clip that is fused with the ends of the fastening strips during manufacture of the bag in accordance with the teachings of U.S. Pat. No. 5,448,807 to Herrington. The end stop may also consist of a separate u-shaped plastic clip that straddles the reclosable fastener and wherein individual clamping members of the clip are secured together by a plastic rivet that pierces the film material of the bag below the reclosable fastener.

It is desirable to be able to latch or secure the slider in its closed position to prevent the bag from accidentally opening. U.S. Pat. No. 5,301,395 to Richardson et al. discloses an end stop provided with an upward pointing hook member at its bottom forward facing edge. The hook member is adapted to extend into a cooperating recess on the bottom wing of the slider. As stated in the disclosure of this patent, the engagement of the recess by the hook member provides the user with a feel of a definite parking position for the slider when the bag is closed. To open the bag, the user must first disengage the hook member from the recess. This opening procedure requires use of brute force to separate the engaged elements. Repeated uses of the slider may cause the inter-engaging parts to wear or weaken and thus diminish the effectiveness of the positive latching feel of the closure.

It would be desirable to releasably latch a slider to an end stop on a bag provided with a reclosable fastener without having to use brute force in order to separate the slider from latching engagement with the end stop.

SUMMARY OF THE INVENTION

The present invention provides a closure device for a slider bag with a slider and an end stop having quick release latching means operable to releasably latch the slider in the closed position and release the slider with minimal user applied force. The closure device comprises first and second interlocking fastening strips arranged to be interlocked over a predetermined length. The slider is slidably disposed on the interlocking fastening strips for facilitating the occlusion and deocclusion of the fastening strips when moved towards first and second ends of the fastening strips. The first and second ends of the fastening strips are secured together and an end stop is provided to the first, closing end of the fastening strips. The end stop is provided with quick release latching structure engagable with cooperating latch-receiving structure provided to the mating or opening end of the slider to secure the slider when it is moved into engagement with the end stop at the closing end of the bag.

In accordance with a preferred embodiment of the invention, the slider is configured as an inverted u-shaped member having an upper portion disposed above the fastening strips and a pair of downwardly extending side walls disposed adjacent to the respective first and second fastening strips of the fastener. The quick release latching structure of the end stop includes a pair of tangs or latch members, disposed spaced apart and adjacent to the first and second fastening strips. Each latch member extends lengthwise away from the closing end of the bag and towards the opening end of the slider and has an outward extending ridge member or projection adapted to be receivingly engaged by a corresponding recess provided to the respective inside side wall surfaces of the opening end of the slider. The tangs or latch members are bendable or deflectable at their free ends, much like a diving board, and are designed to be "grandmother friendly" so that they require only a moderate inward pinching force by a user's thumb and finger to release engagement of the slider.

In accordance with an alternate embodiment of the invention, the quick release latching means comprise a single latch member disposed along one sidewall of the end stop. The procedure for unlatching the slider is essentially the same as above whereby the user applies inward pressure to one side of the end stop to initiate disengagement with the slider.

In accordance with another alternate embodiment of the invention, the quick release latching means comprise a single latch member disposed along the top portion of the end stop. The single top-mounted latch member includes an upstanding ridge member or projection adapted to engage a corresponding recess provided to inner wall of the slider top portion. To initiate unlatching of the slider from the end stop, the user pushes downwardly on the top-mounted latch member of the end stop to move the ridge member or projection out of engagement with the recess in the slider while moving the slider in the opening direction.

In accordance with yet another alternate embodiment of the invention, the engagement and receiving structural parts are reversed whereby the end stop is provided with one ore more recesses and the slider is provided with one or more latch members, each having a ridge or projection adapted to be receivingly engaged within the corresponding recess in the end stop.

Methods and apparatus which incorporate the features described above and which are effective to function as described above constitute further, specific objects of the invention. Other objects and advantages of the invention will become apparent upon reading the following description and upon reference to the drawings.

BRIEF DESCRIPTION OF THE DRAWINGS

For a more complete understanding of this invention reference should now be had to the embodiments illustrated in greater detail in the accompanying drawings and described below by ways of examples of the invention. In the drawings.

DESCRIPTION OF THE PREFERRED EMBODIMENTS

Figure 1:
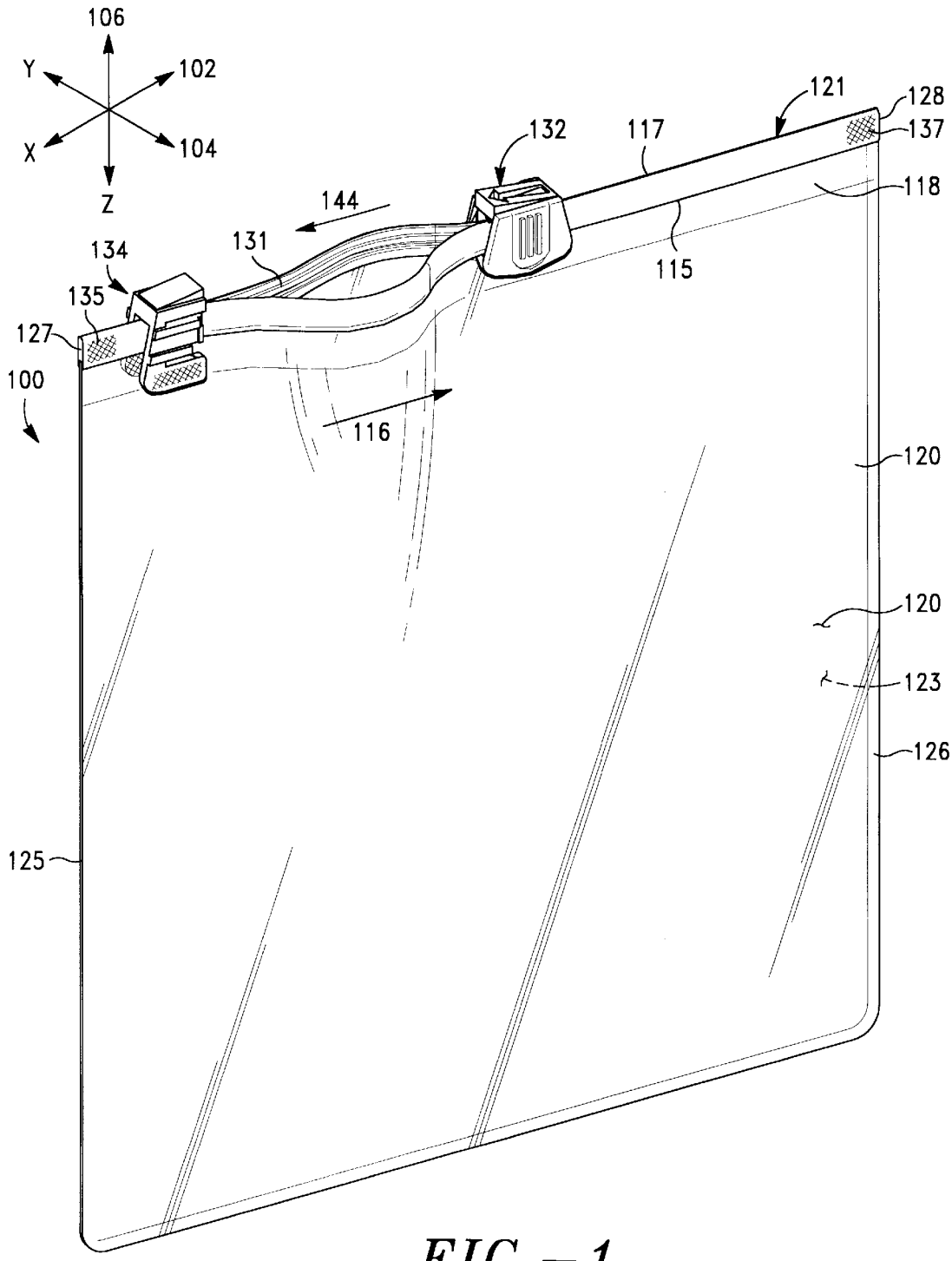
FIG. 1 is a perspective view of a container in the form of a plastic bag having a slider and an end stop provided with means for quick release latching engagement of the slider in accordance with one embodiment of the present invention.

A container constructed in accordance with a preferred embodiment of the present invention is generally designated by reference numeral 100 in FIG. 1. The container 100 is in the form of a plastic food bag 120 having a reclosable fastener device 121 at the open top of the bag 120. The bag 120 includes a first sidewall 122 and a second sidewall 123 joined at seams 125, 126 to define a compartment accessible through the open top but sealable by means of the closure device 121. The closure device 121 includes first and second fastening strips 130, 131 and a slider 132. The fastening strips 130, 131 are adapted to be interlocked between a first end 127 and a second end 128. The fastening strips 130, 131 are secured together at the first and second ends 127, 128 to form end seals. As shown in the figures, the first and second ends 127, 128 include melted portions 135, 137, in which the fastening strips 130, 131 are melted together by heat sealing, ultrasonic sealing or other operation to form the end seals. In other embodiments, the first and second ends 127 and 128 may be secured together by plastic clamps, or by other means. The closure device 121 further includes an end stop 134 disposed proximate the first end 127.

The fastening strips 130, 131, slider 132 and end stop 134 have a longitudinal X-axis 102, a transverse Y-axis 104 and a vertical Z-axis 106. The transverse Y axis 104, the longitudinal X axis 102 and the vertical Z axis 106 are mutually perpendicular to one another and define a three axis coordinate system. The fastening strips 130, 131 each have a bottom edge 115 and a top edge 117. The closure device 121 may include a tape portion 118 that extends downward a distance from the bottom edge 115 of the fastening strips 130, 131 for attachment to the respective first and second sidewalls 122, 123. Alternately, tape portion may be omitted and the sidewalls 122, 123 may be attached directly to the respective first and second fastening strips 130, 131.

The slider 132 straddles the fastening strips 130, 131 and is mounted so that the slider 132 is restrained from being inadvertently pulled off of the fastening strips 130, 131 along the vertical Z axis 106 but is free to slide back and forth along the longitudinal X axis 102. The slider 132 engages the fastening strips 130, 131 so that when the slider moves in the occlusion direction 114, the fastening strips 130, 131 interlock and the bag 120 is sealed, and when the slider 132 moves in a deocclusion direction 116, the fastening strips 130, 131 separate and the bag is open.

Figure 2:
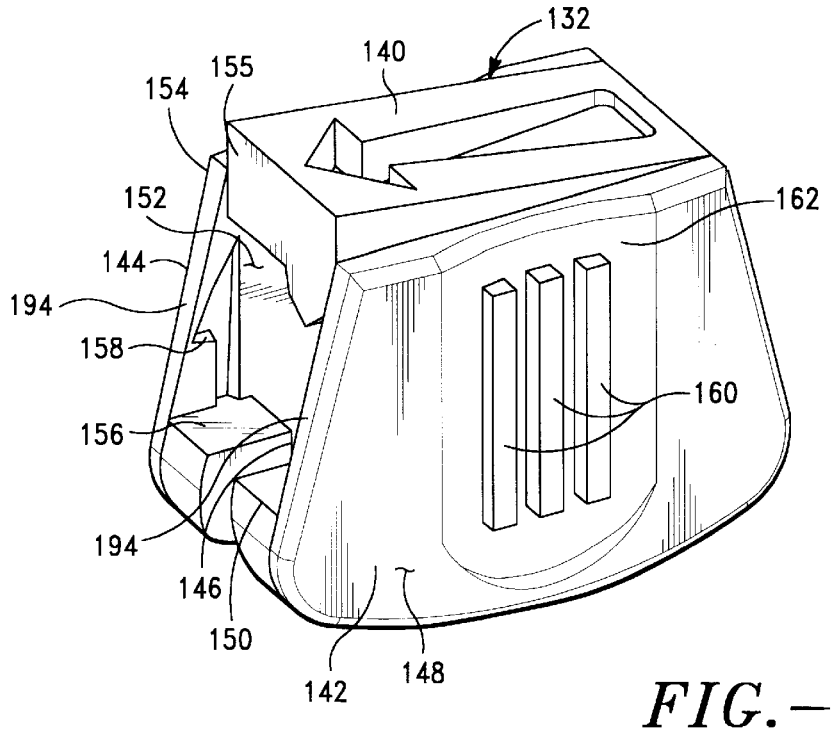
FIG. 2 is an enlarged perspective view of the slider of FIG. 1.
Figure 4:
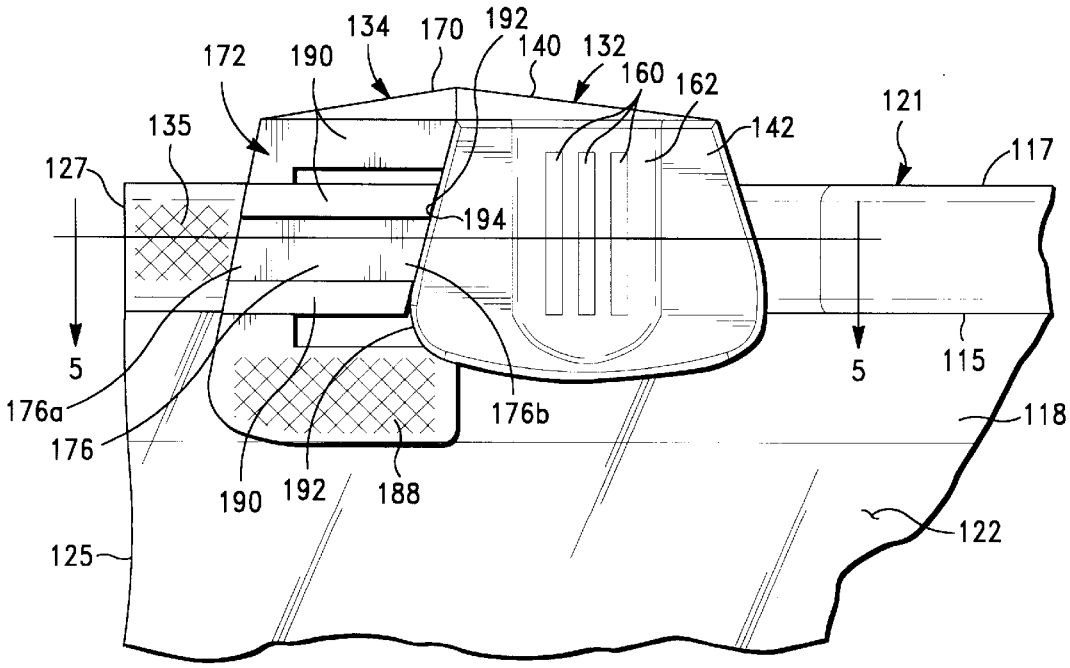
FIG. 4 is an enlarged fragmentary side elevation view of the container of FIG. 1.
Figure 5:
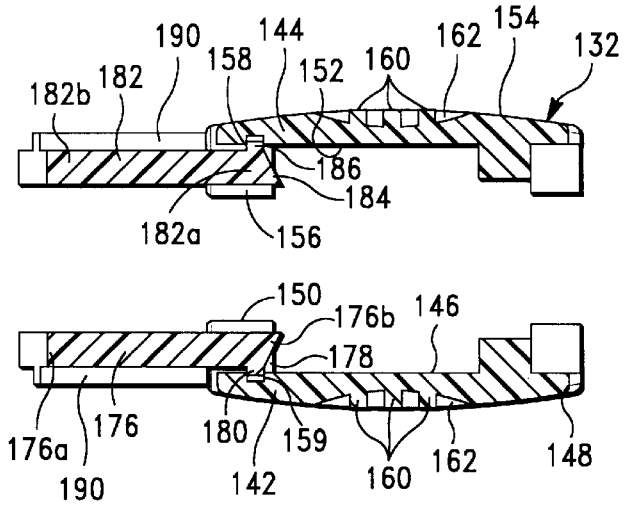
FIG. 5 is a partial cross-sectional view through the end stop and slider taken along the line and in the direction of arrows 5—5 of FIG. 4 (note the reclosable fastener has been omitted for clarity)

FIG. 2 is a perspective view looking into the opening end of the slider 132. The slider 132 includes a top portion 140, a first side portion 142 and a second side portion 144. The first side portion 142 has an inner side wall 146 and an outer side wall 148, and an inwardly directed bottom tab 150. Similarly, the second side portion 144 has an inner side wall 152 and an outer side wall 154, and an inwardly directed bottom tab 156. As best seen in FIGS. 4 and 5, the outer side walls 148 and 154 are bowed outward.

The first and second side portions 142, 144 straddle the respective first and second fastening strips 130, 131 and the inwardly directed tabs 150, 156 mate with the respective bottom edges 115 of the fastening strips 130, 131. The slider 132 is prevented from being accidentally pulled off of the reclosable fastener 121 by the engagement between the upper surfaces of the inwardly directed bottom tabs 150, 156 and the bottom edge 115 of the respective first and second fastening strips 130, 131.

As best seen in FIG. 2, inner sidewall 152 of the second side portion 144 is provided with a recess 158, the purpose of which will be described in greater detail below. Although not visible in FIG. 2, the inner sidewall 146 of the first side portion 142 is similarly provided with a recess 159. In accordance with an alternate embodiment, only one of the first and second side walls is provided with a recess. Each of the outer sidewalls 142 and 154 is provided with upraised ridges 160 which provide gripping areas for the user's fingers when moving the slider 132 back and forth along the reclosable fastener 121. As best seen in FIGS. 2, 4 and 5, the ridges 160 sit within a shallow well 162 provided to the respective outer sidewalls 148, 154 of the first and second side portions 142, 144 so as to maintain the bowed outward contour of the outer sidewalls 148, 154.

Figure 3:
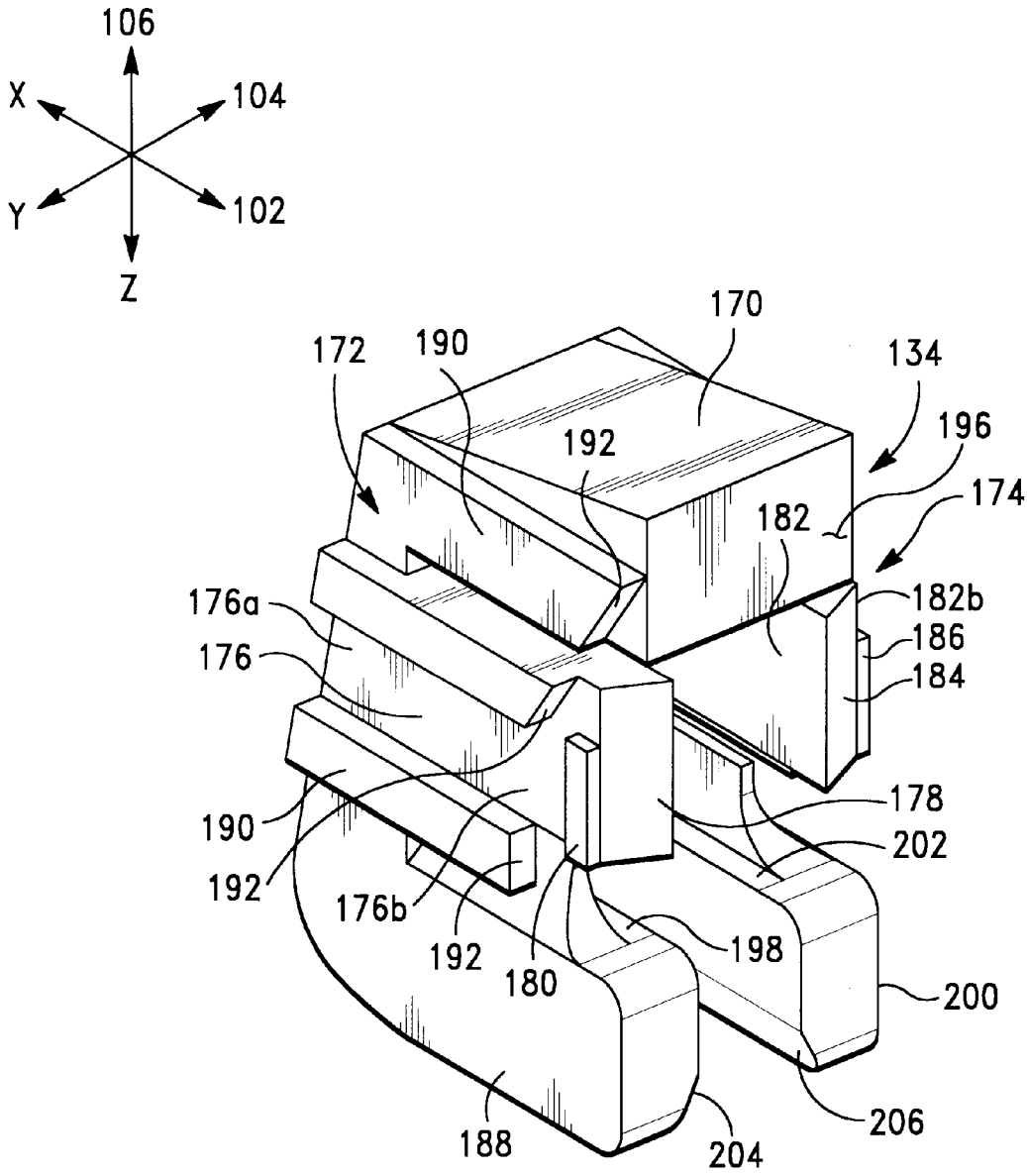
FIG. 3 is an enlarged perspective view of the end stop of FIG. 1.

Referring to FIGS. 3 and 4, the end stop 134 includes a top portion 170, a first side portion 172 and a second side portion 174. The first side portion 172 includes a latch member 176 having a base end **176*a* connected to the first side portion 172 and a free end 176*b* that extends in the longitudinal x-axis 102. The free end 176*b* includes an end face 178 that is tapered inwardly in the direction of the longitudinal x-axis 102. The free end 176*b* further includes a ridge member or projection 180 that extends outwardly in the direction of the transverse y-axis 104. In similar fashion, the second side portion 174 includes a latch member 182 having a base end 182***a* connected to the second side portion 174 and a free end 182*b* that extends in the longitudinal x-axis 102.

The free end 182*b* includes an end face 184 that is tapered inwardly in the direction of the longitudinal x-axis 102. The free end 182*b* further includes a ridge member or projection 186 that extends outwardly in the direction of the transverse y-axis 104.

The end stop 134 straddles the fastening strips 130, 131 at the first end 127 of the bag. End stop side portion 172 includes a bottom portion 188 having an inwardly projecting tab 198 adapted to engage against the bottom edge 115 of fastening strip 130. Similarly, end stop side portion 174 includes a bottom portion 200 having an inwardly projecting tab 202 adapted to engage against the bottom edge 115 of fastening strip 131. The lower inside comers of each tab 198, 202 are provided with upwardly and inwardly tapered surfaces 204 and 206, respectively. The tapered surfaces 204, 206 facilitate snap fit insertion of the end stop 134 onto the reclosable fastener 121. The end stop 134 is secured in straddling position over the reclosable fastener 121 by heat sealing, ultrasonic sealing or other operation to form seals between the bottom portions 188, 200 and the respective adjacent sides of the bag 120.

As best seen in FIG. 4, the slider 132 and the end stop 132 are conformingly contoured in outer appearance so as to provide an aesthetic blend of the two parts and so that they interfacially fit together when the slider 132 is positioned against the end stop 134 at the closing end 127 of the bag 120. The respective top portions 140 and 170 of the slider 132 and end stop 134 slope upward to form a common peak at the point of interfacial engagement between the respective mutually facing end faces 155 and 196 of the slider 132 and end stop 134. Each of the end stop side portions 172 and 174 further include upstanding longitudinally oriented ribs 190 having end faces 192 adapted to conform with and abut against the respective leading edges 194 of the first and second side portions 142, 144 of the slider 132 when the slider is moved into to the fully closed position on the bag 120.

Figure 6:
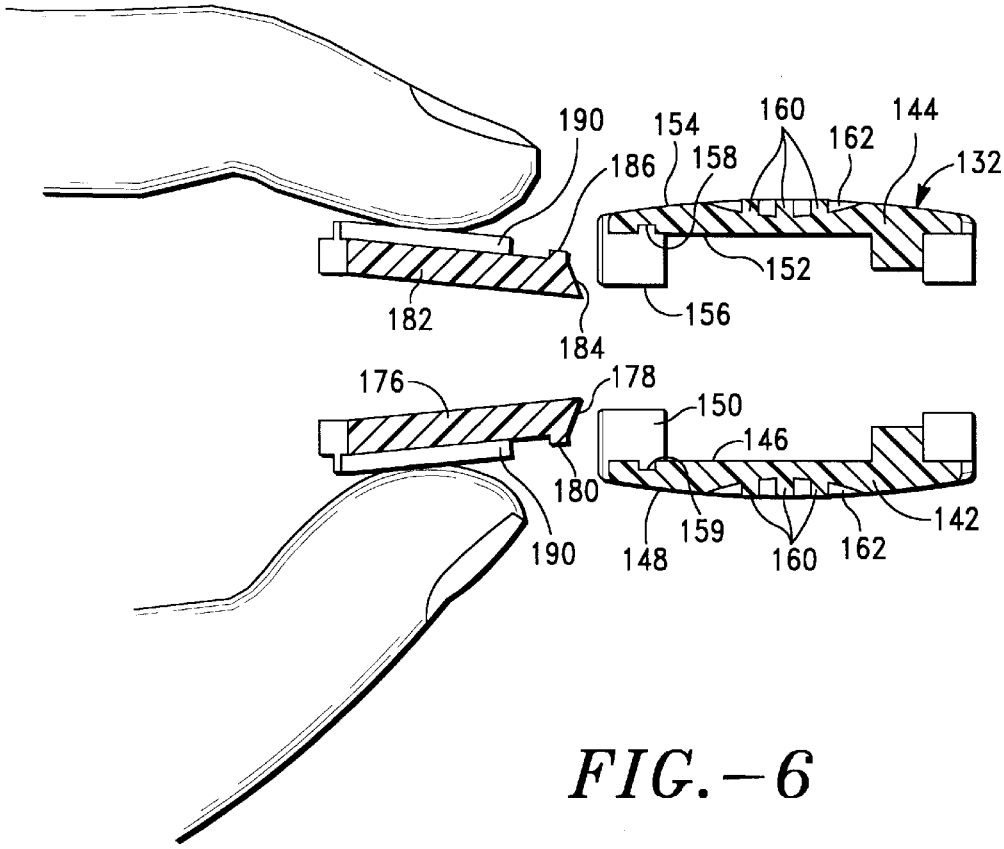
FIG. 6 is a partial cross-sectional view similar to FIG. 5 showing the slider disengaged from the end stop.

In accordance with the present invention there is provided means for the quick release latching engagement of the slider 132 to the end stop 134. Referring now to FIGS. 5 and 6, a positive latching of the slider 132 to the end stop 143 is effectuated by the cooperating receiving engagement of the outward projections 180, 186 on the latch members 176, 184 of the end stop 134 within the corresponding recesses 158, 159 of the slider 132. The inward tapered faces 178, 184 on the respective free ends of latch members 176, 182 help guide the interfacial latching engagement between the slider 132 and end stop 134. The latch members 176, 182 of the end stop 134 are inwardly bendable or deflectable in the direction of the transverse y-axis 104 as shown in FIG. 6. The inward deflection of the latch members 176, 182 moves the respective outward projections 180, 186 out of engagement with the recesses 158, 159 thereby permitting the slider 132 to be moved in the opening direction of the bag. While, a dual latch member arrangement has been shown and described, it is understood that a single latch member arrangement may also be used with equally good results. In other words, the end stop 134 described herein may have only one side portion equipped with a deflectable latch member that is receivingly engagable within a recess provided to an inner sidewall of the slider 132.

Figure 7:
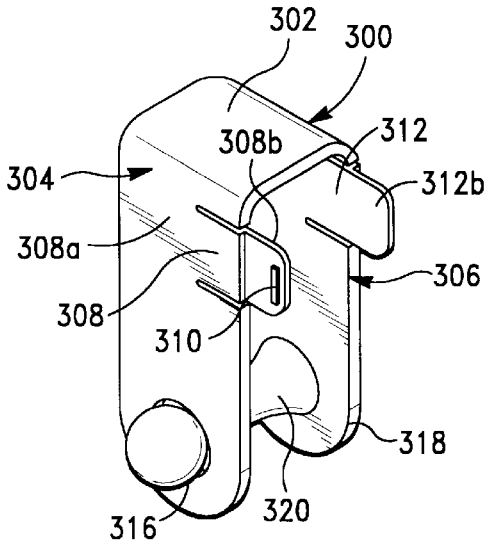
FIG. 7 is a perspective view of an end stop with quick release engagement means in accordance with an alternate embodiment of the present invention.

FIG. 7 illustrates a perspective view of another embodiment of an end stop 300 in accordance with the present invention. The end stop 300 includes a top portion 302, a first side portion 304 and a second side portion 306. The first side portion 304 includes a latch member 308 having a base end 308*a* connected to the first side portion 304 and a free end 308*b* that extends in the longitudinal x-axis 102. The free end 308*b* includes a projection 310 that extends outwardly in the direction of the horizontal y-axis 104. In similar fashion, the second side portion 306 includes a latch member 312 having a base end 312*a* (not visible in the figure) connected to the second side portion 306 and a free end 312*b* that extends in the longitudinal x-axis 102. The free end 312*b* includes a projection 314 (not visible in the figure) that extends outwardly in the direction of the horizontal y-axis 104.

The end stop 300 includes clamp means for clamping together the respective lower pad regions 316, 318 of side portions 304, 306. In accordance with this embodiment, the clamp means comprise a hasp-type fastener including a rivet 320 which holds together the lower pad regions 316, 318. In use, the end stop 300 straddles the reclosable fastener 121 and the lower pad regions 316, 318 act as a pair of clamps on opposite sides of the reclosable fastener 121.

Figure 8:
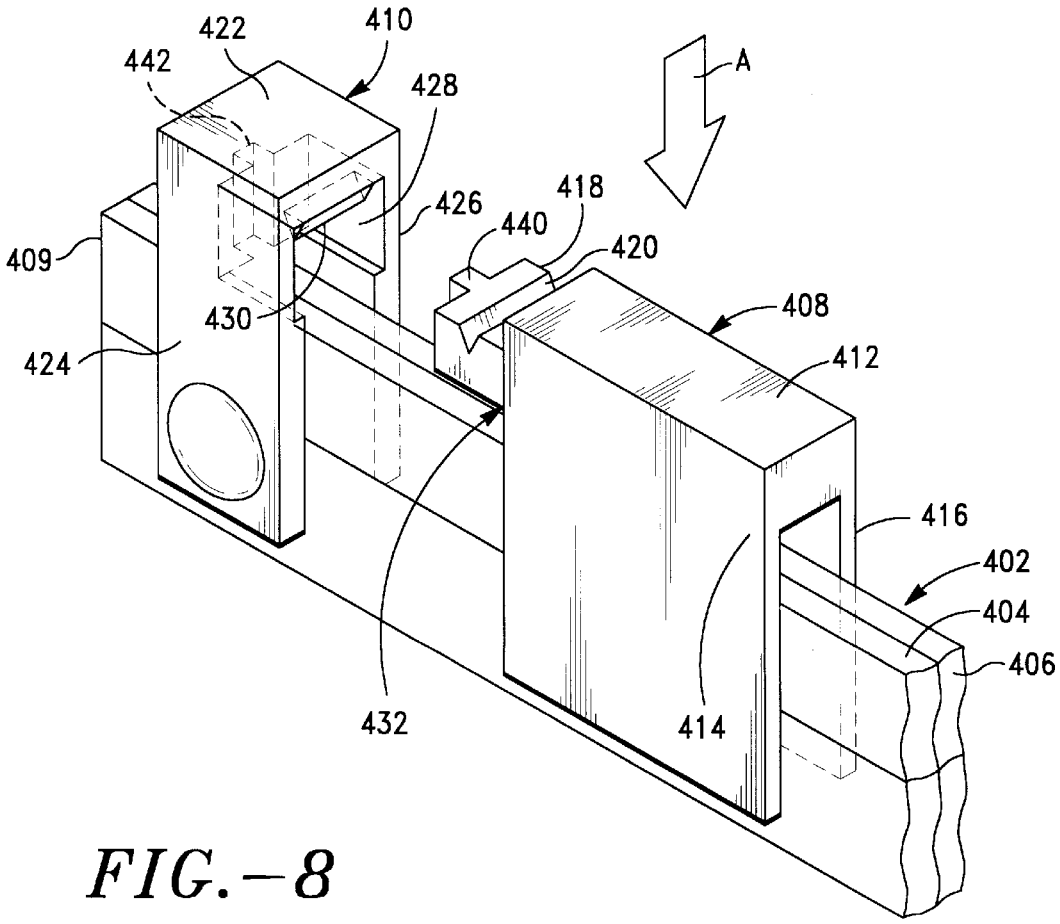
FIG. 8 is a perspective view of another embodiment of the present invention.

FIG. 8 illustrates a perspective view of another embodiment of a flexible food bag-type container 400 with quick release latching structure in accordance with the present invention. The container 400 comprises a closure device 402 including first and second fastening strips 404, 406 and a slider 408. As described above in connection with the prior embodiments, the fastening strips 404, 406 are adapted to be interlocked between a first end 409 and a second end (not shown). The closure device 402 further includes an end stop 410 disposed proximate the first end 409.

The slider 408 is configured as an inverted, generally u-shaped piece that straddles the fastening strips 404, 406 and is mounted to slide back and forth along the longitudinal x-axis 102. Although not shown, the slider 408 may include inwardly directed bottom tab structure that is effective to prevent the slider from being inadvertently pulled off the fastening strips 404, 406. The slider 408 includes a top portion 412, a first side portion 414 and a second side portion 416. The top portion 412 extends a distance above the fastening strips 404, 406. The slider 408 further includes a latch member 418 that extends longitudinally in the direction of the end stop 410 and is elevated a distance above the fastening strips 404, 406. The latch member 418 is provided with a recess 420 along its top surface.

The end stop 410 is also configured as an inverted, generally u-shaped piece including a top portion 422, a first side portion 424 and a second side portion 426. The lower ends of first and second side portions 424, 426 are connected to the sides of the bag either by ultrasonic sealing, heat sealing or by use of a rivet or like mechanical fastening means. The upper ends of the first and second side portions 424, 426 extend a distance above the fastening strips 404, 406, which in combination with the top surface 422 defme a cavity 428 sized to receive the insertion of the latch member 418 as the slider 408 is moved into the closed position on the bag. The upper inside wall of the cavity 428 is provided with a downward extending projection 430 adapted to engage within recess 420 of the latch member 418. The first and second sidewalls 414 and 416 of the slide are cutaway at region 432 adjacent and below the latch member. The cut away portions 432 permit the end stop-facing end of the slider top portion 412 to bend downward upon the application of finger pressure applied to the top portion 412 just aft of the latch member as indicated by the directional arrow A. The downward deflection of the latch member 418 frees the recess 420 from latching engagement with the projection 430 thereby allowing the slider 408 to be freely moved in the opening direction of the bag. As shown, the latch member 418 may further include a locator member in the form of a longitudinally projecting member 440, which is cooperably received within a corresponding recess 442 provided to the back wall of cavity 428.

Figure 9:
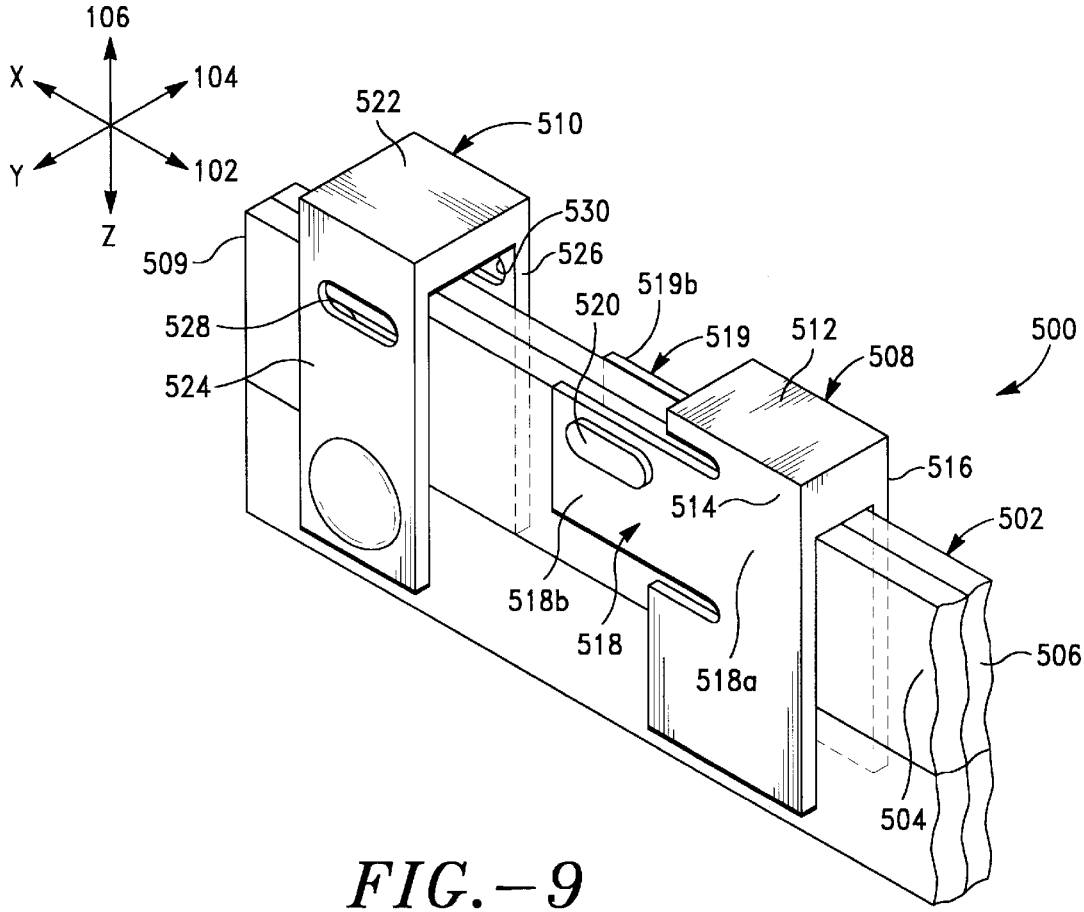
FIG. 9 is a perspective view of another embodiment of the present invention.

FIG. 9 illustrates a perspective view of another embodiment of a flexible food bag-type container 500 with quick release latching structure in accordance with the present invention. The container 500 comprises a closure device 502 including first and second fastening strips 504, 506 and a slider 508. As described above in connection with the prior embodiments, the fastening strips 504, 506 are adapted to be interlocked between a first end 509 and a second end (not shown). The closure device 502 further includes an end stop 510 disposed proximate the first end 509.

The slider 508 is configured as an inverted, generally u-shaped piece that straddles the fastening strips 504, 506 and is mounted to slide back and forth along the longitudinal x-axis 102. Although not shown, the slider 508 may include inwardly directed bottom tab structure that is effective to prevent the slider from being inadvertently pulled off the fastening strips 504, 506. The slider 508 includes a top portion 512, a first side portion 514 and a second side portion 516. The first side portion 514 includes a latch member 518 having a base end 518*a* connected to the first side portion 514 and a free end 518*b* that extends in the longitudinal x-axis 102. The latch member free end 518*b* includes a ridge member or projection 520 that extends outwardly in the direction of the transverse y-axis 104. In similar fashion, the second side portion 516 includes a latch member 519 having a base end 519*a* (not visible in the Figure) connected to the second side portion 516 and a free end 519*b* that extends in the longitudinal x-axis 102. The second latch free end 519*b* includes a ridge member or projection 521 (not visible in the Figure) that extends outwardly in the direction of the transverse y-axis 104.

The end stop 510 is also configured as an inverted, generally u-shaped piece including a top portion 522, a first side portion 524 and a second side portion 526. The lower ends of first and second side portions 524, 526 are connected to the sides of the bag either by ultrasonic sealing, heat sealing or by use of a rivet or like mechanical fastening means. The first end stop side portion 524 includes recess structure, in this example hole 528, sized to receivingly engage the projection 520 of latch member 518 of the slider first side portion 514. Similarly, the second end stop side portion 526 includes a hole 530 sized to receivingly engage the projection provided to the latch member 519 of the slider second side portion 516. The latch members 518, 519 of the slider 508 are inwardly bendable or deflectable in the direction of the transverse y-axis.

The inward deflection of the latch members 518, 519 moves the respective outward projections 520, 521 out of engagement with the holes 528, 530 thereby permitting the slider 508 to be moved in the opening direction of the bag. This embodiment is substantially a reversal of parts of the embodiment shown and described above in connection with FIGS. 2–6.

Although several interlocking fastening strip embodiments have been specifically described and illustrated herein, it will be readily appreciated by those skilled in the art that other kinds, types, or forms of fastening strips can alternatively be used without departing from the scope or spirit of the present invention.

The interlocking fastening strips may be manufactured by extrusion through a die and may be formed from any suitable thermoplastic material including, for example, polyethylene, polypropylene, nylon, or the like, or from a combination thereof. Thus, resins or mixtures of resins such as high-density polyethylene, medium-density polyethylene, and low-density polyethylene may be employed to prepare the interlocking fastening strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low-density polyethylene and linear, low-density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations. The slits may be cut during the manufacturing of the fastening strips using rollers which contain an appropriately placed knife edge.

Generally, the fastening strips can be manufactured in a variety of forms to suit the intended use. The fastening strips may be integrally formed on the opposing sidewalls of the container or bag, or connected to the container by the use of any of several known methods. For example, a thermoelectric device may be applied to a film in contact with the flange portion of the fastening strips or the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding may be done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one-piece construction. The slider can be colored, opaque, translucent or transparent. The slider may be injection molded or made by any other method. The slider may be molded from any suitable plastic material, such as high-density polyethylene, polypropylene, nylon, acetal, toughened acetal, polyketone, polybutylene terrephthalate, polycarbonate or ABS (acrylonitrile-butadiene-styrene)

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. On the contrary, it is intended to cover all alternatives, modifications and equivalents as may be included within the spirit and scope of the invention as defined by the appended claims.

What is claimed is:

1. A closure device, comprising:

first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips; and interfacial latching means for latching respective abutting faces of said slider to said end stop when said slider is moved into contact with said end stop and wherein said interfacial latching means is operable to release said slider from latching engagement with said end stop upon application of finger pressure by a user along an axis transverse to said x-axis.

2. The invention of claim 1 wherein said interfacial latching means includes:

a recess provided to said slider; and a deflectable latch member having a fixed end connected to said end stop and an extended free end disposed facing said slider, said free end of said latch member having a projection thereon, said latch member being normally biased to urge said projection into receiving engagement within said recess so as to restrain movement of said slider when said slider is brought into contact with said end stop.

3. The invention of claim 2 wherein said end stop includes a top portion and first and second side portions depending from said top portion, and wherein said latch member is connected to said top portion.

4. The invention of claim 2 wherein said end stop includes a top portion and first and second side portions depending from said top portion, and wherein said latch member is connected to one of said first and second side portions.

5. The invention of claim 4 wherein said end stop includes a second latch member provided to the other of said first and second side portions.

6. The invention of claim 1 wherein said interfacial latching means includes:

a recess provided to said end stop; and a deflectable latch member having a fixed end connected to said slider and an extended free end disposed facing said end stop, said free end of said latch member having a projection thereon, said latch member being normally biased to urge said projection into receiving engagement within said recess so as to restrain movement of said slider when said slider is brought into contact with said end stop.

7. The invention of claim 6 wherein said slider includes a top portion and first and second side portions depending from said top portion, and wherein said latch member is connected to said top portion.

8. The invention of claim 6 wherein said slider includes a top portion and first and second side portions depending from said top portion, and wherein said latch member is connected to one of said first and second side portions.

9. The invention of claim 8 wherein said slider includes a second latch member provided to the other of said first and second side portions.

10. The invention of claim 1 wherein said slider and end stop are conformingly contoured in outer appearance to provide an aesthetic blend of the two parts when interfacially fit together.

11. A container comprising:

first and second sidewalls joined at seams to form a compartment with an open top;

first and second interlocking fastening strips respectively connected to said first and second sidewalls at said open top, said first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips; and interfacial latching means for latching respective abutting faces of said slider to said end stop when said slider is moved into contact with said end stop and wherein said interfacial latching means is operable to release said slider from latching engagement with said end stop upon application of finger pressure by a user along an axis transverse to said x-axis.

12. The invention of claim 11 wherein said interfacial latching means includes:

a recess provided to said slider; and a deflectable latch member having a fixed end connected to said end stop and an extended free end disposed facing said slider, said free end of said latch member having a projection thereon, said latch member being normally biased to urge said projection into receiving engagement within said recess so as to restrain movement of said slider when said slider is brought into contact with said end stop.

13. The invention of claim 12 wherein said end stop includes a top portion and first and second side portions depending from said top portion, and wherein said latch member is connected to said top portion.

14. The invention of claim 12 wherein said end stop includes a top portion and first and second side portions depending from said top portion, and wherein said latch member is connected to one of said first and second side portions.

15. The invention of claim 14 wherein said end stop includes a second latch member provided to the other of said first and second side portions.

16. The invention of claim 11 wherein said interfacial latching means includes:

a recess provided to said end stop; and a deflectable latch member having a fixed end connected to said slider and an extended free end disposed facing said end stop, said free end of said latch member having a projection thereon, said latch member being normally biased to urge said projection into receiving engagement within said recess so as to restrain movement of said slider when said slider is brought into contact with said end stop.

17. The invention of claim 16 wherein said slider includes a top portion and first and second side portions depending from said top portion, and wherein said latch member is connected to said top portion.

18. The invention of claim 16 wherein said slider includes a top portion and first and second side portions depending from said top portion, and wherein said latch member is connected to one of said first and second side portions.

19. The invention of claim 18 wherein said slider includes a second latch member provided to the other of said first and second side portions.

20. The invention of claim 11 wherein said slider and end stop are conformingly contoured in outer appearance to provide an aesthetic blend of the two parts when interfacially fit together.

21. A closure device, comprising:

first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips;

said end stop includes a deflectable latch member cooperable with recess structure on said slider for restraining movement of said slider when said slider is moved into engagement with said end stop and wherein said latch member is operable to release said slider upon application of finger pressure by a user along an axis transverse to said x-axis; and wherein said latch member has a fixed end connected to said end stop and an extended free end disposed facing said slider, said free end of said latch member having a projection thereon, said latch member being normally biased to urge said projection into receiving engagement within said recess structure so as to restrain movement of said slider when said slider is brought into contact with said end stop.

22.The invention of claim 21 wherein said end stop includes a top portion and first and second side portions depending from said top portion, and wherein said latch member is connected to said top portion.

23. The invention of claim 21 wherein said end stop includes a top portion and first and second side portions depending from said top portion, and wherein said latch member is connected to one of said first and second side portions.

24. The invention of claim 23 wherein said end stop includes a second latch member provided to the other of said first and second side portions.

25. The invention of claim 21 wherein said slider and end stop are conformingly contoured in outer appearance to provide an aesthetic blend of the two parts when interfacially fit together.

26. A closure device, comprising:

first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips;

said slider includes a deflectable latch member cooperable with recess structure on said end stop for restraining movement of said slider when said slider is moved into engagement with said end stop and wherein said latch member is operable to release said slider upon application of finger pressure by a user along an axis transverse to said x-axis; and wherein said latch member has a fixed end connected to said slider and an extended free end disposed facing said end stop, said free end of said latch member having a projection thereon, said latch member being normally biased to urge said projection into receiving engagement within said recess structure so as to restrain movement of said slider when said slider is brought into contact with said end stop.

27. The invention of claim 26 wherein said slider includes a top portion and first and second side portions depending from said top portion, and wherein said latch member is connected to said top portion.

28. The invention of claim 26 wherein said slider includes a top portion and first and second side portions depending from said top portion, and wherein said latch member is connected to one of said first and second side portions.

29. The invention of claim 28 wherein said slider includes a second latch member provided to the other of said first and second side portions.

30. The invention of claim 26 wherein said slider and end stop are conformingly contoured in outer appearance to provide an aesthetic blend of the two parts when interfacially fit together.

31. A container comprising:

first and second sidewalls joined at seam to form a compartment with an open top;

first and second interlocking fastening strips respectively connected to said first and second sidewalls at said open top, said first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips;

said end stop includes a deflectable latch member cooperable with recess structure on said slider for restraining movement of said slider when said slider is moved into engagement with said end stop and wherein said latch member is operable to release said slider upon application of finger pressure by a user along an axis transverse to said x-axis; and wherein said latch member has a fixed end connected to said end stop and an extended free end disposed facing said slider, said free end of said latch member having a projection thereon, said latch member being normally biased to urge said projection into receiving engagement within said recess structure so as to restrain movement of said slider when said slider is brought into contact with said end stop.

32. The invention of claim 31 wherein said end stop includes a top portion and first and second side portions depending from said top portion, and wherein said latch member is connected to said top portion.

33. The invention of claim 31 wherein said end stop includes a top portion and first and second side portions depending from said top portion, and wherein said latch member is connected to one of said first and second side portions.

34. The invention of claim 33 wherein said end stop includes a second latch member provided to the other of said first and second side portions.

35. The invention of claim 31 wherein said slider and end stop are conformingly contoured in outer appearance to provide an aesthetic blend of the two parts when interfacially fit together.

36. A container comprising:

first and second sidewalls joined at seam to form a compartment with an open top;

first and second interlocking fastening strips respectively connected to said first and second sidewalls at said open top, said first and second interlocking fastening strips arranged to be interlocked over a predetermined x-axis between first and second ends, the fastening strips being secured together at the first and second ends;

a slider straddling the fastening strips adapted to occlude the fastening strips when moved toward the first end and deocclude the fastening strips when moved toward the second end;

an end stop mounted proximate to the first end of said fastening strips;

said slider includes a deflectable latch member cooperable with recess structure on said end stop for restraining movement of said slider when said slider is moved into engagement with said end stop and wherein said latch member is operable to release said slider upon application of finger pressure by a user along an axis transverse to said x-axis; and wherein said latch member has a fixed end connected to said slider and an extended free end disposed facing said end stop, said free end of said latch member having a projection thereon, said latch member being normally biased to urge said projection into receiving engagement within said recess structure so as to restrain movement of said slider when said slider is brought into contact with said end stop.

37. The invention of claim 36 wherein said slider includes a top portion and first and second side portions depending from said top portion, and wherein said latch member is connected to said top portion.

38. The invention of claim 36 wherein said slider includes a top portion and first and second side portions depending from said top portion, and wherein said latch member is connected to one of said first and second side portions.

39. The invention of claim 38 wherein said slider includes a second latch member provided to the other of said first and second side portions.

40. The invention of claim 36 wherein said slider and end stop are conformingly contoured in outer appearance to provide an aesthetic blend of the two parts when interfacially fit together.

* * * * *